United States Patent [19]

Fuller et al.

[11] Patent Number: 4,919,220

[45] Date of Patent: Apr. 24, 1990

[54] CUTTING STRUCTURES FOR STEEL BODIED ROTARY DRILL BITS

[75] Inventors: John Fuller, Penzance, Cornwall; Michael C. Regan, Robinswood, Gloucester, both of England

[73] Assignee: Reed Tool Company, Ltd., London, England

[21] Appl. No.: 148,072

[22] Filed: Jan. 25, 1988

[30] Foreign Application Priority data

Jul. 19, 1984 [6B] Great Britain ..... 8418481

Related U.S. Application Data

[60] Continuation-in-part of Ser. No. 118,604, Nov. 9, 1987, Pat. No. 4,823,892, which is a division of Ser. No. 754,506, Jul. 12, 1985, Pat. No. 4,718,505.

[51] Int. Cl.[5] ..... E21B 10/46

[52] U.S. Cl. ..... 175/329; 76/108.2; 175/410

[58] Field of Search ..... 175/329, 330, 409, 410, 175/411; 228/122, 123, 163.11, 163.16; 76/108 A, 108 R, DIG. 12

[56] References Cited

U.S. PATENT DOCUMENTS

| | | | |
|---|---|---|---|
| 4,156,329 | 5/1979 | Daniels et al. | 175/330 |
| 4,225,322 | 9/1980 | Knemeyer | 175/329 |
| 4,350,215 | 9/1982 | Radtke | 228/122 |
| 4,397,361 | 8/1983 | Langford, Jr. | 175/329 |
| 4,505,721 | 3/1985 | Almond et al. | 175/410 |
| 4,624,830 | 11/1986 | Barr | 175/329 |
| 4,686,080 | 8/1987 | Hara et al. | 175/329 |
| 4,699,227 | 10/1987 | Wardley | 175/329 |
| 4,726,718 | 2/1988 | Meskin et al. | 175/329 |

*Primary Examiner*—Stephen J. Novosad
*Assistant Examiner*—Terry Lee Melius
*Attorney, Agent, or Firm*—Browning, Bushman, Anderson & Brookhart

[57] ABSTRACT

A rotary drill bit for use in drilling or coring holes in subsurface formations comprises a bit body having a shank for connection to a drill string, a plurality of cutting structures mounted at the surface of the bit body, and a passage in the bit body for supplying drilling fluid to the surface of the bit body for cooling and/or cleaning the cutting structures. The bit body is formed from steel, and each cutting structure comprises a cutting element, in the form of a unitary layer of thermally stable polycrystalline diamond material, brazed to a carrier received in a socket in the steel body of the bit.

18 Claims, 4 Drawing Sheets

CUTTING STRUCTURES FOR STEEL BODIED ROTARY DRILL BITS

CROSS REFERENCE TO RELATED APPLICATIONS

This is a continuation-in-part of U.S. application Ser. No. 118,604, filed Nov. 9, 1987, now U.S. Pat. No. 4,823,892, which in turn is a division of application Ser. No. 754,506, filed July 12, 1985, now U.S. Pat. No. 4,718,505.

BACKGROUND OF THE INVENTION

The invention relates to rotary drill bits for use in drilling or coring holes in subsurface formations, and of the kind comprising a bit body having a shank for connection to a drill string, a plurality of cutting structures mounted at the surface of the bit body, and a passage in the bit body for supplying drilling fluid to the surface of the bit body for cooling and/or cleaning the cutting structures.

In a common form of such a drill bit the cutting structures comprise so-called "preform" cutting elements. Each cutting element is in the form of a tablet, usually circular or part-circular, having a hard cutting face formed of polycrystalline diamond or other superhard material. Normally, each such preform cutting element is formed in two layers: a hard facing layer formed of polycrystalline diamond or other superhard material, and a backing layer formed of less hard material, such as cemented tungsten carbide.

In one commonly used method of making rotary drill bits of the above mentioned type, the bit body is formed by a powder metallurgy process. In this process a hollow mould is first formed, for example from graphite, in the configuration of the bit body or a part thereof. The mould is packed with powdered material, such as tungsten carbide, which is then infiltrated with a metal alloy binder, such as copper alloy, in a furnace so as to form a hard matrix. The maximum furnace temperature required to form the matrix may be of the order of 1050° to 1170° C. Conventional two-layer preforms of the kind described, however, are only thermally stable up to a temperature of 700° to 750° C. For this reason preform cutting elements are normally mounted on the bit body after it has been moulded. There are, however, now available polycrystalline diamond materials which are thermally stable up to and beyond the range of infiltration temperatures referred to above. Such thermally stable diamond materials are, for example, supplied by the General Electric Company under the trade name "GEOSET" and by De Beers under the trade name "SYNDAX 3".

These materials have been applied to matrix-bodied bits by setting pieces of the material in the surface of a bit body so as to project partly from the surface. The pieces have been, for example, in the form of a thick element of triangular shape, one apex of the triangle projecting from the surface of the drill bit and the general plane of the triangle extending either radially or tangentially. Means have also been devised for mounting on matrix-bodied bits thermally stable elements of similar configuration to the non-thermally stable two-layer elements of the kind previously described, for example elements in the form of circular tablets. Arrangements and methods for mounting such thermally stable cutting elements on matrix bodied bits are described in U.S. Pat. No. 4,624,830.

Although such thermally stable preform cutting elements are of obvious application to matrix bodied bits, since they may be incorporated in the surface of the bit body during the process of moulding the bit body, the present invention is based on the application of thermally stable preform cutting elements to drill bits where the bit body is formed from steel.

SUMMARY OF THE INVENTION

According to the invention there is provided a rotary drill bit for use in drilling or coring holes in subsurface formations, comprising a bit body having a shank for connection to a drill string, a plurality of cutting structures mounted at the surface of the bit body, and a passage in the bit body for supplying drilling fluid to the surface of the bit body for cooling and/or cleaning the cutting structures, the bit body being formed from steel, at least one of the cutting structures comprising a cutting element, in the form of a unitary layer of thermally stable polycrystalline diamond material, bonded to a carrier received in a socket in the steel body of the bit.

The use of thermally stable polycrystalline diamond cutting elements on a steel bodied bit, in accordance with the invention, has significant advantages. Thus, in use of the drill bit, thermally stable cutting elements can withstand higher working temperatures than non-thermally stable cutters. Furthermore, since the cutting elements can sustain higher temperatures without damage, higher brazing temperatures may be used to bond the elements to their respective carriers and this results in a stronger bond between each cutting element and its carrier so as to give less risk of the cutting element becoming detached from its carrier in use.

Prior art matrix bodied bits, of the kind referred to above, where the thermally stable cutting elements are moulded into the surface of the bit body during manufacture, do not allow replacement of cutting elements following wear or breakage of such elements during use. A drill bit according to the present invention, on the other hand, permits ready replacement of cutting structures sinch they may simply be removed from the sockets in the steel body and replaced. This is a particularly straightforward procedure if the carriers of the cutting structures are shrink-fitted in the sockets, since they may be removed simply by heating the bit body to the required temperature. Shrink-fitting is less common in matrix bodied bits due to difficulties in accurately sizing the sockets in such bits, and for this reason if separately formed cutting structures are to be secured in preformed sockets in matrix bodied bits they are usually brazed into the sockets with the result that they can only be replaced by heating the bit body to a sufficiently high temperature to melt the braze.

A further advantage of the invention is that it allows thermally stable and non-thermally stable cutting elements to be used on one and the same steel bit body if required, and this is not possible with matrix bodied bits where the cutting elements are cast into the surface of the bit during manufacture. Due to the different characteristics of thermally stable and non-thermally stable cutting elements there may be advantage in using different types of element in different locations on the bit body. For example, it may be preferred to use thermally stable cutters in areas where, in use, the greatest loads are generated, thus causing the highest temperatures.

DETAILED DESCRIPTION OF THE PREFERRED EMBODIMENTS

Figure 1:
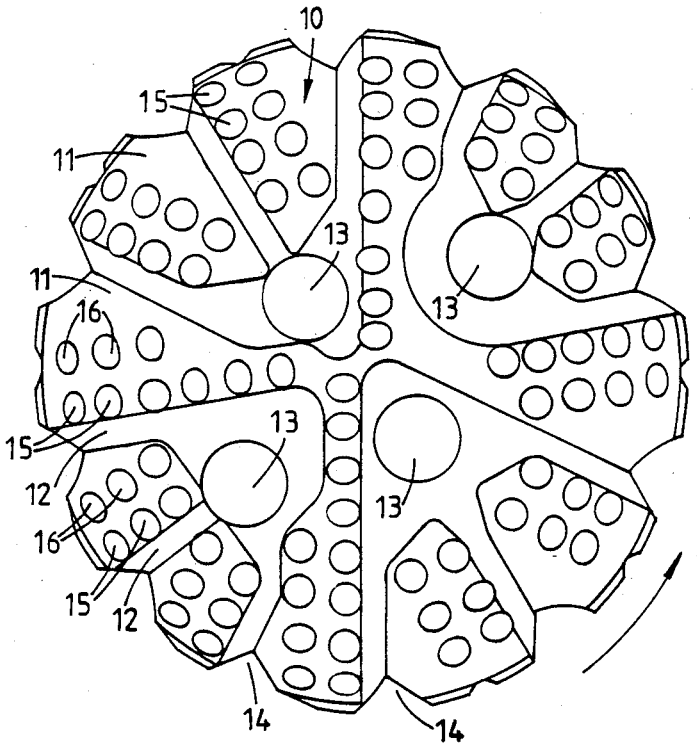
FIGS. 1 and 2 are front end views of rotary drill bits of the kind to which the invention is applicable.

The rotary bit body of FIG. 1 has a leading end face formed with a plurality of blades 11 upstanding from the surface of the bit body so as to define between the blades channels 12 for drilling fluid. The channels 12 lead outwardly from nozzles 13 to which drilling fluid passes through a passage (not shown) within the bit body. Drilling fluid flowing outwardly along the channels 12 passes to junk slots 14 in the gauge portion of the bit.

Mounted on each blade 11 is a row of cutting elements 15. The cutting elements project into the adjacent channel 12 so as to be cooled and cleaned by drilling fluid flowing outwardly along the channel from the nozzles 13 to the junk slots 14. Spaced rearwardly of the three or four outermost cutting elements on each blade are abrasion elements 16. In the arrangement shown each abrasion element lies at substantially the same radial distance from the axis of rotation of the bit as its associated cutting element, although other configurations are possible.

Figure 2:
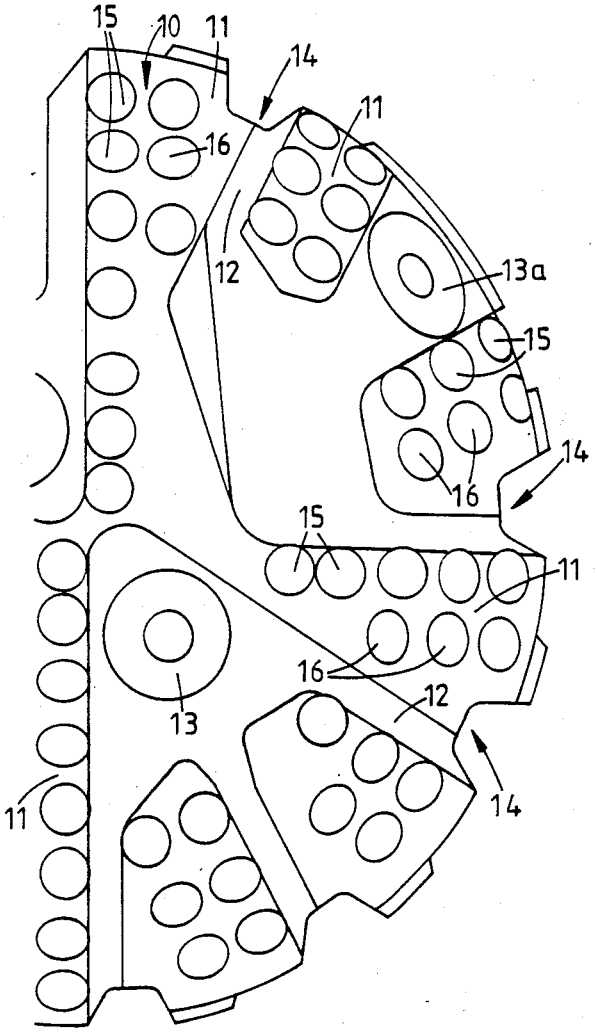

FIG. 2 shows an alternative and preferred arrangement in which some of the nozzles are located adjacent the gauge region of the drill bit, as indicated at 13*a* in FIG. 2. The flow from such a peripheral nozzles passes tangentially across peripheral portions of the leading face of the bit to the junk slots 14, thus ensuring a rapid and turbulent flow of drilling fluid over the intervening abrasion and cutting elements so as to cool and clean them with efficiency.

Figure 3:
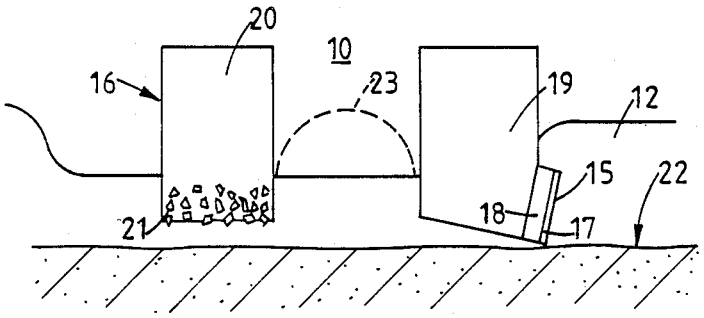
FIG. 3 is a diagrammatic section through a part of the bit body showing a cutting structure and an associated abrasion element.

In either of the arrangements described, the cutting elements 15 and abrasion elements 16 may be of many different forms, but FIG. 3 shows, by way of example, one particular configuration.

Referring to FIG. 3, it will be seen that each cutting element 15 is a circular preform comprising a front thin hard facing layer 17 of polycrystalline diamond bonded to a thicker backing layer 18 of less hard material, such as tungsten carbide. The cutting element 15 is bonded, in known manner, to an inclined surface on a generally cylindrical stud 19 which is received in a socket in the bit body 10. The stud 19 may be formed from cemented tungsten carbide and the bit body 10 may be formed from steel.

Each abrasion element 16 also comprises a generally cylindrical stud 20 which is received in a socket in the bit body 10 spaced rearwardly of the stud 19. The stud 20 may be formed from cemented tungsten carbide impregnated with particles 21 of natural or synthetic diamond or other superhard material. The superhard material may be impregnated throughout the body of the stud 20 or may be embedded in only the surface portion thereof.

Figure 4:
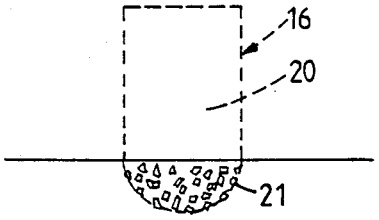
FIG. 4 is a front view of an abrasion element and, FIGS. 5 to 8 are similar views to FIG. 3 of alternative arrangements.

Referring to FIG. 4, it will be seen that each abrasion element 16 may have a leading face which is generally part-circular in shape.

The abrasion element 16 may project from the surface of the bit body 10 to a similar extent to the cutting element, but preferably, as shown, the cutting element projects outwardly slightly further than its associated abrasion element, for example by a distance in the range of from 1 to 10 mm. Thus, initially before any significant wear of the cutting element has occurred, only the cutting element 15 engages the formation 22, and the abrasion element 16 will only engage and abrade the formation 22 when the cutting element has worn beyond a certain level, or has failed through fracture.

In the arrangement shown, the stud 20 of the abrasion element is substantially at right angles to the surface of the formation 22, but operation in softer formations may be enhanced by inclining the axis of the stud 20 forwardly or by inclining the outer surface of the abrasion element away from the formation in the direction of rotation.

In order to improve the cooling of the cutting elements and abrasion elements, further channels for drilling fluid may be provided between the two rows of elements as indicated at 23 in FIG. 3.

Figure 6:
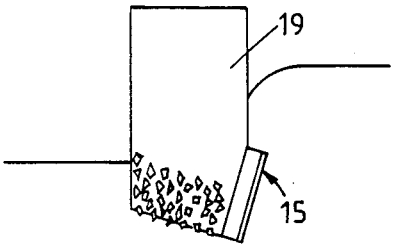
Figure 7:
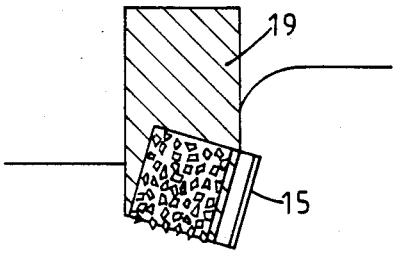

Although the abrasion elements 16 are preferably spaced from the cutting elements 15 to minimise heat transfer from the abrasion element to the cutting element, each abrasion element may instead be incorporated in the support stud for a cutting element. Such arrangements are shown in FIGS. 6 and 7. In the arrangement of FIG. 6 particles of diamond or other superhard material are impregnated into the stud 19 itself rearwardly adjacent the cutting element 15. In the alternative arrangement shown in FIG. 7, a separately formed abrasion element impregnated with superhard particles is included in the stud.

Figure 5:
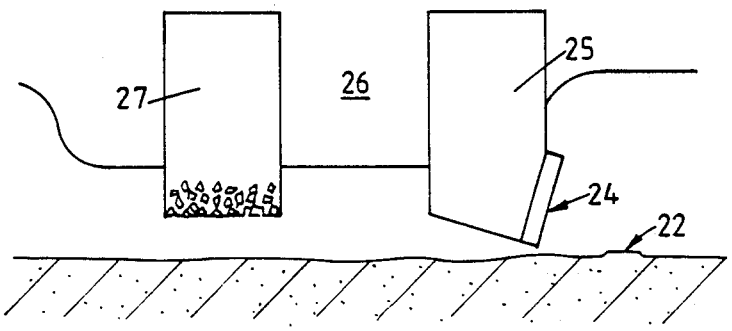

FIG. 5 shown an arrangement according to the invention where the cutting element 24 is in the form of a unitary layer of thermally stable polycrystalline diamond material bonded without a backing layer to the surface of a carrier in the form of stud 25, for example of cemented tungsten carbide, which is received in a socket in a bit body 26 which is formed from steel. An abrasion element 27 is spaced rearwardly of each cutting element 24, but it will also be appreciated that the form of cutting element shown in FIG. 5 may also be used in any conventional manner in a steel body bit without the additional abrasion elements in accordance with the present invention.

Thermally stable polycrystalline diamond cutting elements may also be bonded to the studs in the arrangements of FIGS. 6 and 7, instead of the two-layer preform cutting elements 15 of the kind described above.

In such arrangements according to the invention the thermally stable polycrystalline diamond cutting element 24 may be bonded to the surface of the stud 25 by brazing, preferably by vacuum brazing. It is essential that the brazing alloy includes an element such as titanium, chromium or vanadium which will wet the surface of the cutting element and react with the diamond (carbon atom) to form a carbide layer. We have discovered that alloys having the following chemical composition (by weight percent) are suitable:

Cr: 6.0–8.0
B: 2.75–3.50
Si: 4.0–5.0
Fe: 2.5–3.5
C: 0.06 max
Ni: Balance which has a range of brazing temperatures of approximately 1010° C. to 1175° C. Such temperature range can be tolerated by the thermally stable cutting element. One particularly suitable alloy, supplied by Meglas Products under the code MBF 20/20A has the following composition:

Cr: 7.0
B: 3.2
Si: 4.5
Fe: 3.0
C: 0.06
Ni: Balance

Such alloy has an approximate brazing temperature of 1066° C. which can be tolerated by the thermally stable cutting element.

Other suitable brazing alloys have the following compositions:

Cr: 19.0
B: 1.5
Si: 7.3
C: 0.08
Ni: Balance (supplied by Metglas Products under the code MBF 50/50A) with a brazing temperature of about 1177° C. which can be tolerated by the thermally stable cutting element.

Cr: 15.2
B: 4.0
C: 0.06
Ni: Balance (supplied by Metglas Products under the code MBF 80/80A) with a brazing temperature of about 1177° C. which can be tolerated by the thermally stable cutting element.

Another brazing alloy which we have found to be suitable is supplied by GTE Products Corporation under the trade name "INCUSIL-15 ABA" and has the following composition:

Cu: 23.5
In: 14.5
Ti: 1.25
Ag: Balance with a range of brazing temperatures of approximately 750° C. to 770° C., which, of course, can be tolerated by the thermally stable cutting element.

We have also discovered that thermally stable polycrystalline diamond cutting elements may be brazed to tungsten carbide studs by alloys based on copper-manganese and copper-manganese-iron powders with chromium additions.

There is a significant differential between two coefficients of thermal expansion of tungsten carbide and polycrystalline diamond and this can lead to substantial stresses being set up in the elements during brazing, which can lead to cracking and failure of the diamond or tungsten carbide either during brazing or subsequently during use of the drill bit. Such stresses can be reduced by sandwiching a metal shim between the thermally stable cutting element and the tungsten carbide carrier during brazing. A cutting structure formed by such method is illustrated diagrammatically in FIG. 8.

Figure 8:
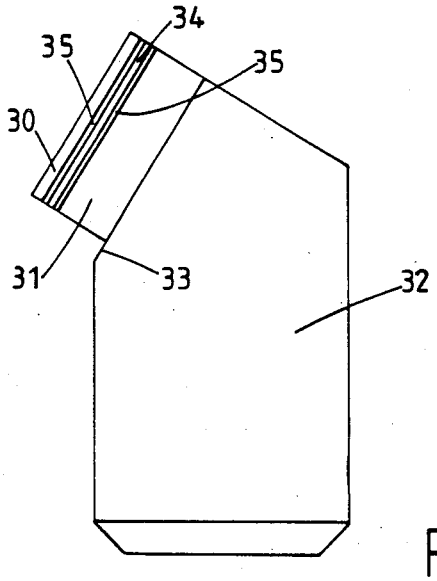

In the embodiment of FIG. 8 the thermally stable polycrystalline diamond cutting element 30 is in the form of a circular disc and the carrier for the thermally stable cutting element is formed in two parts: a backing element 31 of cemented tungsten carbide in the form of a thicker disc of the same diameter as the cutting element, and a generally cylindrical tungsten carbide stud 32 having a surface 33 inclined to the longitudinal axis of the stud and to which the backing element 31 is bonded, for example by brazing.

The cutting element 30 is also bonded to the backing element 31 by brazing, for example by using any of the brazing alloys referred to above, but in this case a metal shim 34 is sandwiched between the cutting element 30 and backing element 31 during brazing. The shim may be of copper, nickel or a copper-nickel alloy. Conveniently, the two sides of the shim 34 may be coated with the brazing alloy before insertion of the shim. The layers of brazing alloy are indicated at 35 in FIG. 8, the thickness of the layers and of the shim being exaggerated for clarity. Similarly, the cutting element 30 could be brazed to a one-piece carrier or stud by the same technique.

The studs of the cutting structures may be secured within the sockets in the steel bit body in any normal manner, for example by brazing or shrink-fitting or by a combination thereof.

We claim:

1. A rotary drill bit for use in drilling or coring holes in subsurface formations, comprising a bit body having a shank for connection to a drill string, a plurality of cutting structures mounted at the surface of the bit body, and a passage in the bit body for supplying drilling fluid to the surface of the bit body for cooling and/or cleaning the cutting structures, the bit body being formed from steel, at least one of the cutting structures comprising a cutting element, in the form of a preformed unitary layer of polycrystalline diamond material which is thermally stable up to a temperature higher than 750° C., the pre-formed layer being bonded to a carrier received in a socket in the steel body of the bit.

2. A rotary drill bit according to claim 1, wherein each carrier comprises a stud received in a socket in the bit body, the stud being pre-formed in one piece and the pre-formed unitary layer of thermally stable polycrystalline diamond material being bonded directly to a surface on the stud.

3. A rotary drill bit according to claim 2, wherein each stud is formed from cemented tungsten carbide.

4. A rotary drill bit according to claim 1, wherein each carrier comprises a backing element bonded to a surface on a stud which is received in a socket in the bit body, the preformed unitary layer of thermally stable polycrystalline diamond material being bonded to a surface of the backing element.

5. A rotary drill bit according to claim 4, wherein each stud is formed from cemented tungsten carbide.

6. A rotary drill bit according to claim 4, wherein each backing element is formed from cemented tungsten carbide.

7. A rotary drill bit according to claim 1, wherein each pre-formed unitary layer of thermally stable polycrystalline diamond material is brazed to its respective carrier.

8. A rotary drill bit according to claim 7, wherein a metal shim is sandwiched between the pre-formed unitary layer of thermally stable polycrystalline diamond material and its carrier.

9. A rotary drill bit according to claim 8, wherein the metal of the shim is selected from copper, nickel or copper-nickel alloy.

10. A method of manufacturing a rotary drill bit for use in drilling or coring holes in subsurface formations, comprising forming from steel a bit body having a shank for connection to a drill string, a plurality of sockets at the surface of the bit body, and a passage in the bit body for supplying drilling fluid to the surface of the bit body, forming at least one of a plurality of cutting structures by bonding to a carrier a pre-formed unitary layer of polycrystalline diamond material which is thermally stable up to a temperature higher than 750° C., and mounting the cutting structures at the surface of the steel bit body by securing the carriers of the cutting structures within respective sockets in the bit body.

11. A method according to claim 10, including the step of brazing each pre-formed unitary layer of thermally stable polycrystalline diamond material to its respective carrier.

12. A method according to claim 11, including the step of sandwiching a metal shim between the pre-formed unitary layer of thermally stable polycrystalline diamond material and the carrier when brazing the cutting element to the carrier.

13. A method according to claim 12, wherein the metal of the shim is selected from copper, nickel or copper-nickel alloy.

14. A method according to claim 10, wherein each carrier comprises a stud received in a socket in the bit body, the stud being pre-formed in one piece and the pre-formed unitary layer of thermally stable polycrystalline diamond material being bonded directly to a surface on the stud.

15. A method according to claim 14, wherein each stud is formed from cemented tungsten carbide.

16. A method according to claim 10, wherein each carrier comprises a backing element bonded to a surface on a stud which is received in a socket in the bit body, the pre-formed unitary layer of thermally stable polycrystalline diamond material being bonded to a surface of the backing element.

17. A method according to claim 16, wherein each stud is formed from cemented tungsten carbide.

18. A method according to claim 16, wherein each backing element is formed from cemented tungsten carbide.

* * * * *